United States Patent [19]

Scheurecker

[11] Patent Number: 4,479,529

[45] Date of Patent: Oct. 30, 1984

[54] STRAND GUIDING STAND TO BE USED IN A CONTINUOUS CASTING PLANT

[75] Inventor: Werner Scheurecker, Linz, Austria

[73] Assignee: Voest-Alpine Aktiengesellschaft, Linz, Austria

[21] Appl. No.: 365,409

[22] Filed: Apr. 5, 1982

[30] Foreign Application Priority Data

Apr. 22, 1981 [AT] Austria ..... 1812/81

[51] Int. Cl.[3] ..... B22D 11/12; B22D 11/128

[52] U.S. Cl. ..... 164/442; 164/448

[58] Field of Search ..... 164/442, 448, 484, 441, 164/447

[56] References Cited

U.S. PATENT DOCUMENTS

| | | | |
|---|---|---|---|
| 4,007,822 | 2/1977 | Scheurecker | 164/448 |
| 4,046,188 | 9/1977 | Kagerhuber et al. | 164/448 |
| 4,076,069 | 2/1978 | Scheinecker et al. | 164/448 |

FOREIGN PATENT DOCUMENTS

| | | | |
|---|---|---|---|
| 1965115 | 7/1971 | Fed. Rep. of Germany | 164/448 |

*Primary Examiner*—Kuang Y. Lin
*Assistant Examiner*—Richard K. Seidel
*Attorney, Agent, or Firm*—Brumbaugh, Graves, Donohue & Raymond

[57] ABSTRACT

In a strand guiding stand including oppositely arranged stand parts connected by drawing anchors and on which strand guiding rollers are journaled, at least one of the stand parts is displaceable, and fixable, by a displacement device along the drawing anchors. The displacement device includes at least one bushing on each drawing anchor, with a helical supporting surface. Each bushing leans against a fixed abutment of the drawing anchor and the displaceable stand part is supported on the bushing. In order to prevent a change in the distance of the oppositely arranged strand guiding rollers and to be able to adjust the distance automatically merely by rotating the bushings, the helical supporting surface of each bushing has an angle of inclination that is larger than the pertaining angle of friction. The bushings are motionally coupled and synchronously turnable by an adjustment drive fixable in different positions, and are provided only on the ends of the drawing anchors that penetrate the displaceable stand part. The displaceable stand part is pressable against the bushings by a clamping device.

5 Claims, 4 Drawing Figures

STRAND GUIDING STAND TO BE USED IN A CONTINUOUS CASTING PLANT

BACKGROUND OF THE INVENTION

The invention relates to a strand guiding stand for a continuous casting plant, in particular for a continuous casting plant for slabs, comprising oppositely arranged stand parts connected by drawing anchors, on which strand guiding rollers are journaled, at least one of the stand parts being displaceable, and fixable, by a displacement means along the drawing anchors, which displacement means includes at least one bushing on each drawing anchor with a helical supporting surface, each bushing leaning against a fixed abutment of the drawing anchor and the displaceable stand part being supported on the bushing, preferably on the helical supporting surface.

A stand of this kind is known from U.S. Pat. No. 4,007,822. The bushings provided on the drawing anchors as relieving means have helical supporting surfaces whose angles of inclination are smaller than the pertaining angles of friction so that the bushings are self-locking with respect to forces acting in the axial direction of the drawing anchors, which means that forces acting from the strand on the rollers do not cause an automatic unturning of the bushings. In order to change the distance of oppositely arranged strand guiding rollers, spacers of different dimensions, depending upon the desired spacing, may be inserted between the displaceable stand part and the bushings because of the slight axial displacement path, the bushings subsequently being tightened. Exchanging and shifting the spacers is time consuming and cumbersome.

SUMMARY OF THE INVENTION

The invention aims at avoiding these disadvantages and difficulties and has as its object to provide a strand guiding stand of the initially defined kind, in which the exchange of spacers for the purpose of changing the distance of the oppositely arranged strand guiding rollers is not required. Instead, the distance of the oppositely arranged strand guiding rollers is to be adjustable automatically merely by turning the bushings, which also act as a relieving means.

This object is achieved according to the invention in that

- the helical supporting surface of each bushing has an angle of inclination that is larger than the pertaining angle of friction,
- the bushings are coupled and turnable, by means of an adjustment drive fixable in different positions, so that their adjustments are synchronous
- the bushings are provided only on the ends of the drawing anchors that penetrate the displaceable stand part, and
- the displaceable stand part is pressable against the bushings by a clamping means, the clamping means preferably being provided on each drawing anchor.

It is known from U.S. Pat. No. 4,076,069 to change the distance of oppositely arranged strand guiding rollers by turning bushings having helical supporting surfaces; yet, with this known solution, bushings with helical supporting surfaces are provided on both sides of the displaceable stand parts for the purpose of reaching a greater displacement path, since the helical supporting surfaces of the bushings also have angles of inclination that are smaller than the pertaining angles of friction.

Due to the plurality of bushings provided, this solution is expensive, however. Furthermore, a plurality of adjustment drives is required, which disadvantage is also avoided according to the invention.

According to a preferred embodiment the clamping means is designed as a helical spring peripherally surrounding the drawing anchor and leaning against the displaceable stand part on the one hand and against an abutment of the drawing anchor on the other hand.

According to a further suitable embodiment the clamping means is designed as a pressure medium cylinder supported on the displaceable stand part on the one hand and on the drawing anchor on the other hand.

Advantageously, the adjustment drive is designed as a self-locking threaded spindle.

BRIEF DESCRIPTION OF THE DRAWINGS

The invention will now be explained in more detail by way of two embodiments and with reference to the accompanying drawings, wherein.

DESCRIPTION OF EXEMPLARY EMBODIMENTS

Figure 1:
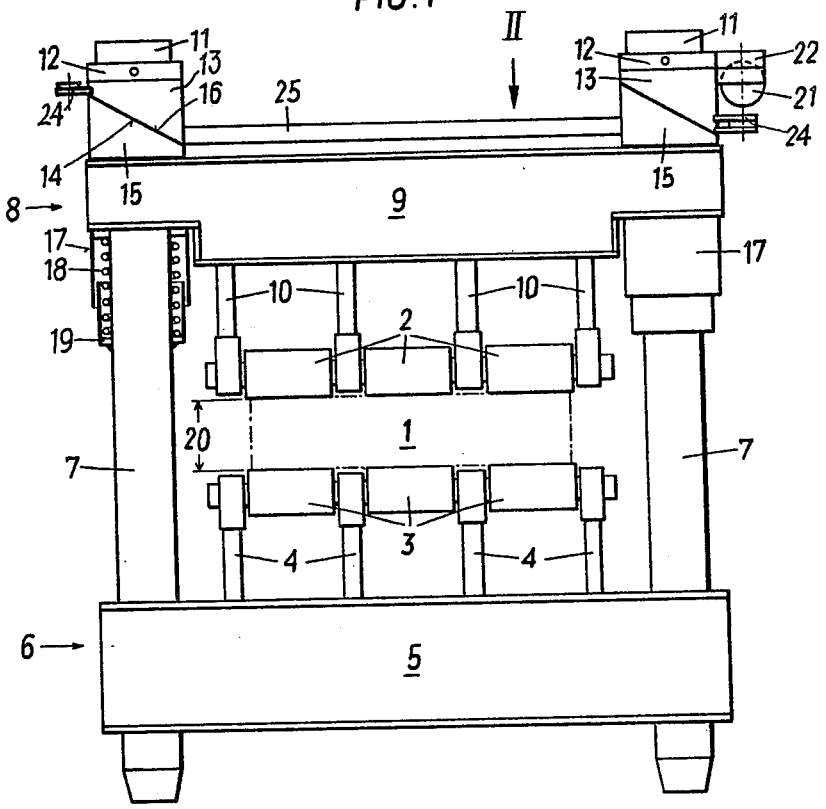
FIG. 1 is a view of the strand guide in the direction of the longitudinal axis of the strand according to one embodiment.

A strand 1 is guided and supported between oppositely arranged strand guiding rollers 2 and 3. The strand guiding rollers 3 supporting the strand 1 on the outer or lower side are journaled via longitudinal carriers 4 on two transverse carriers 5, which are supported on the base. This stationary stand part 6, which is formed by the transverse carriers 5 and the longitudinal carriers 4 fastened thereto, is opposed by a stand part 8 that is displaceable along drawing anchors 7 and composed of transverse carriers 9 and longitudinal carriers 10 carrying the rollers 2.

The drawing anchors 7, which are provided in the corner points of the ground section of the stand, are rigidly fixed to the ends of the transverse carriers 5. To each end 11 of the drawing anchors 7 projecting through the displaceable stand part 8 a collar-like abutment 12 is fastened, against which a bushing 13 is supported. This bushing 13 has a plane supporting surface directed towards the collar-like abutment 12 as well as a helical supporting surface 14 directed towards the displaceable stand part 8, the helical supporting surface 14 having an angle of inclination that is larger than the pertaining angle of friction.

The displaceable stand part 8 is supported relative to each of these bushings 13 by means of a further bushing 15, which comprises a helical counter supporting surface 16 corresponding to the helical supporting surface 14 of the first bushing. A helical spring 18 peripherally surrounding each drawing anchor 7 and inserted in a spring cup 17, is supported against the displaceable stand part 8 on the one hand and against an abutment 19 of the drawing anchor on the other hand, and serves as a clamping means for automatically pressing the displaceable stand part towards the two bushings 13 and 15 provided on the ends of each of the drawing anchors.

The adjustment of the distance 20 of the oppositely arranged strand guiding rollers 2 and 3 is effected by an adjustment drive 21 fixable in different positions. This adjustment drive, which is designed as a self-locking threaded spindle in the embodiment illustrated and in which an, advantageously electric, distance indicator is installed, on the one hand is hinged to a lever 22 extending radially from the drawing anchor and on the other hand is hinged to a lever 23 extending radially from one of the bushings 13. The rotatable bushings 13 are motionally coupled in a mechanical manner, i.e., by means of articulation rods 25 hinged to projections 24 of the bushings, so that the rotation of the bushings, which are rotatable by the adjustment drive, is transmitted synchronously to the remaining rotatable bushings 13 provided on each of the drawing anchors 7 by means of the articulation rods 25.

The actuation of the adjustment drive 21 causes a certain rotation angle of all of the rotatable bushings 13, whereby the displaceable stand part 8, which is resiliently pressed against the bushings, is displaced with respect to the stationary stand part 6.

Figure 2:
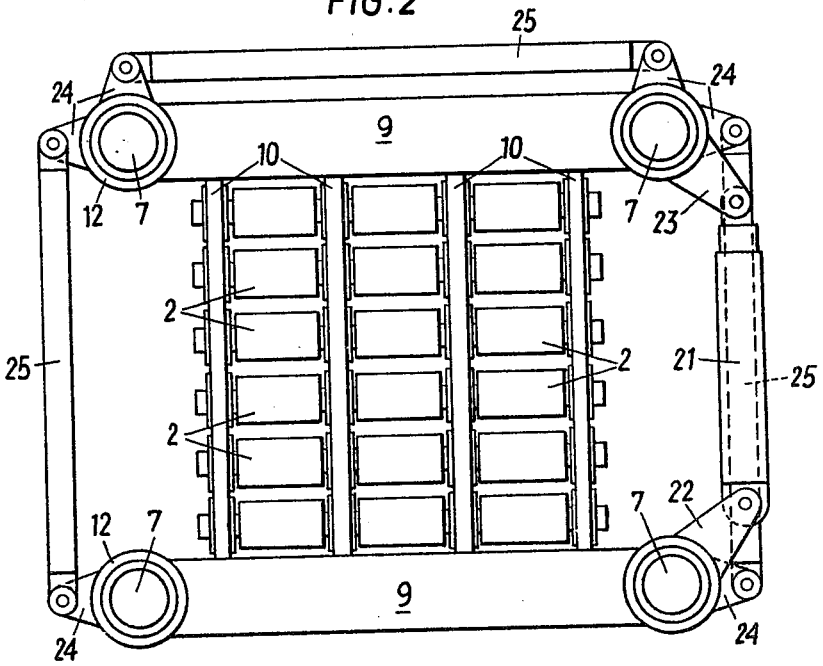
FIG. 2 is a view in the direction of the arrow II of FIG. 1.
Figure 3:
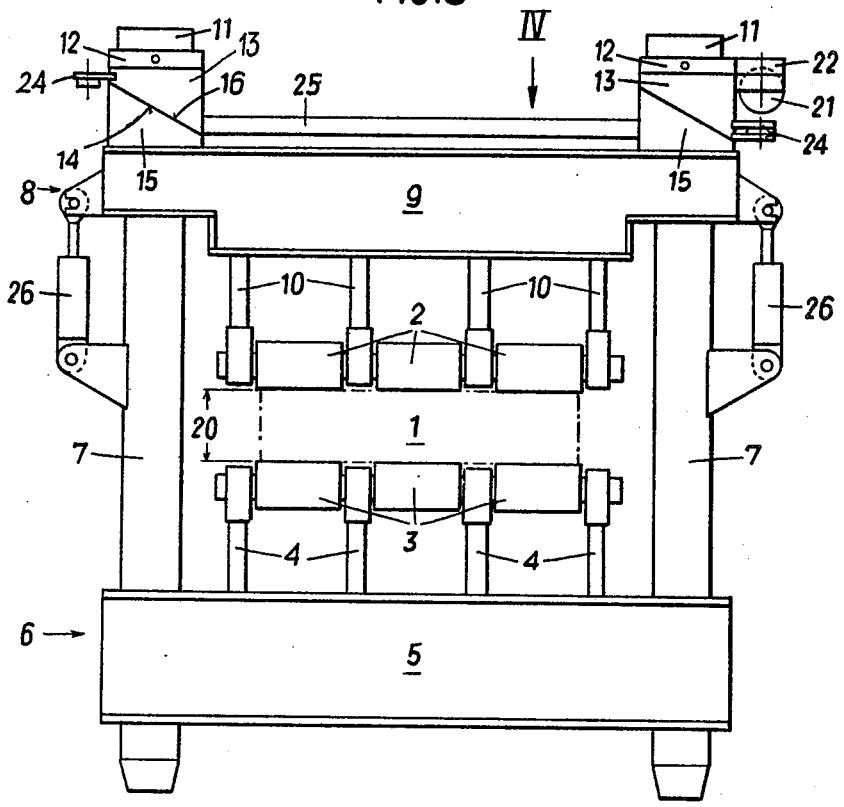
FIGS. 3 and 4 represent a further embodiment in illustrations analogous to FIGS. 1 and 2.
Figure 4:
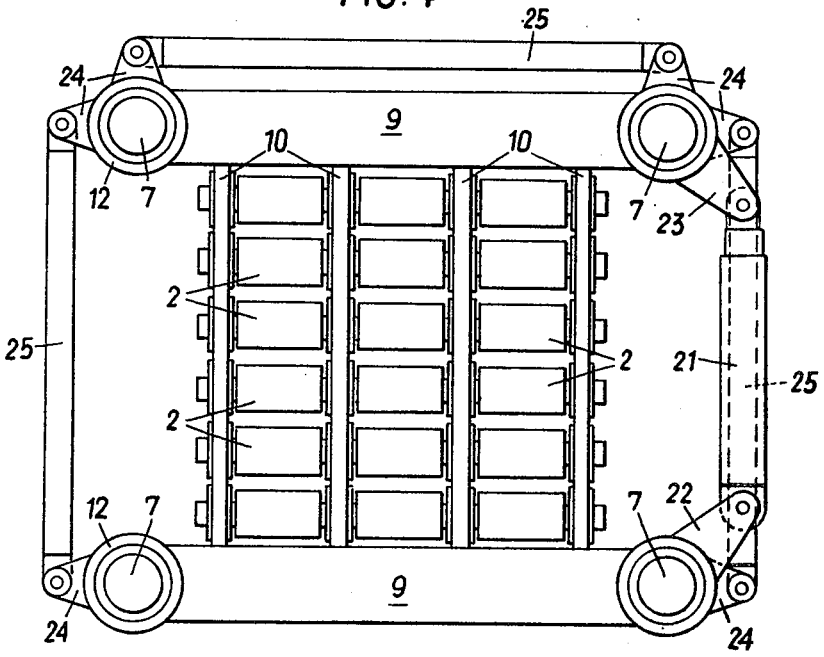

The embodiment illustrated in FIGS. 3 and 4 basically corresponds to the strand guiding stand represented in FIGS. 1 and 2. It merely differs in that pressure medium cylinders 26 are provided at each drawing anchor instead of the clamping means designed as helical springs 18, which cylinders are hinged to the displaceable stand part 8 on the one hand and to the drawing anchors 7 on the other hand.

Due to the fact that the adjustment drive is fixable in different positions, forces that act from the strand 1 onto the stand parts 6, 8 cannot effect a rotation of the bushings 13, although these bushings are equipped with helical supporting surfaces whose angle of inclination is larger than the pertaining angle of friction. On account of this special design of the helical supporting surfaces it is, however, possible to reach a relatively large displacement path for the displaceable stand part 8 and to adjust the distance 20 continuously.

Instead of the adjustment drive designed as a self-locking threaded spindle 21, a pressure medium cylinder could be provided, for instance, in addition to other adjustment drives, whose piston rod is fixable in certain positions so that the pressure medium cylinder has to be actuated only for the purpose of rotating the bushings.

For long strand guiding paths, as they are required with fast continuous casting plants, it is either possible to arrange subsequently several of the strand guides illustrated in the drawings or to use continuous longitudinal carriers extending over the total length of the strand guideway and mounted on a plurality of transverse carriers. There, the rotatable bushings are provided at each drawing anchor connecting the oppositely arranged transverse carriers. In particular, it is possible to equip strand guides in which the rollers are journaled in arcuate longitudinal carriers with the bushings 13, 15 according to the invention.

What I claim is:

1. In a strand guiding stand to be used in a continuous casting plant, in particular a continuous casting plant for slabs, and of the type including a fixed stand part and an oppositely arranged displaceable stand part, drawing anchors connecting said fixed and displaceable stand parts, strand guiding rollers journaled on said fixed and displaceable stand parts, a displacement means for displacing, and fixing, said displaceable stand part along said drawing anchors at a desired position opposite said fixed stand part, said displacement means including at least one bushing provided on each of said drawing anchors and having a helical supporting surface, said displaceable stand part being supported on said at least one bushing, and a fixed abutment provided on each of said drawing anchors for supporting said bushing, the improvement wherein said drawing anchors each have an end that projects through said displaceable stand part, said bushings being provided only on said drawing anchor ends, and said helical supporting surface of each bushing has an angle of inclination that is larger than the pertaining angle of friction, the improvement further comprising means for coupling said bushings for synchronous rotation, an adjustment drive fixable in different positions and adapted for synchronously rotating said bushings, and clamping means provided on each of said drawing anchors for constantly urging said displaceable stand part against said bushings.

2. A strand guiding stand as set forth in claim 1, wherein said displaceable stand part is supported on said helical supporting surfaces of said bushings.

3. A strand guiding stand as set forth in claim 1, wherein said clamping means is designed as a helical spring peripherally surrounding said drawing anchor, and which comprises a further abutment provided on said drawing anchor, said helical spring being supported against said displaceable stand part and against said abutment.

4. A strand guiding stand as set forth in claim 1, wherein said clamping means is designed as a pressure medium cylinder supported on said displaceable stand part and on said drawing anchor.

5. A strand guiding stand as set forth in claim 1, wherein said adjustment drive is designed as a self-locking threaded spindle.

* * * * *